US010500629B2

(12) United States Patent
Roth

(10) Patent No.: US 10,500,629 B2
(45) Date of Patent: Dec. 10, 2019

(54) METHOD FOR REDUCING SPRINGBACK USING ELECTRICALLY-ASSISTED MANUFACTURING

(71) Applicant: The Penn State Research Foundation, University Park, PA (US)

(72) Inventor: John Timothy Roth, Mckean, PA (US)

(73) Assignee: The Penn State Research Foundation, University Park, PA (US)

( * ) Notice: Subject to any disclaimer, the term of this patent is extended or adjusted under 35 U.S.C. 154(b) by 300 days.

(21) Appl. No.: 15/517,838

(22) PCT Filed: Oct. 7, 2015

(86) PCT No.: PCT/US2015/054520
§ 371 (c)(1),
(2) Date: Apr. 7, 2017

(87) PCT Pub. No.: WO2016/057688
PCT Pub. Date: Apr. 14, 2016

(65) Prior Publication Data

US 2018/0264538 A1 Sep. 20, 2018

Related U.S. Application Data

(60) Provisional application No. 62/060,607, filed on Oct. 7, 2014.

(51) Int. Cl.
*B21D 31/00* (2006.01)
*B21D 37/16* (2006.01)

(52) U.S. Cl.
CPC ..... *B21D 31/005* (2013.01); *B21D 37/16* (2013.01)

(58) Field of Classification Search
CPC .... B21D 31/005; B21D 37/16; B21D 24/005; B21D 24/16; B21D 26/06; B21D 26/12
(Continued)

(56) References Cited

U.S. PATENT DOCUMENTS 6,047,582 A * 4/2000 Daehn ..... B21D 22/02 72/430
7,467,532 B2 * 12/2008 Golovashchenko ... B21D 26/14 72/430

(Continued)

FOREIGN PATENT DOCUMENTS

FR 2646623 A1 11/1990
RU 2194588 C2 12/2002
WO 2002026414 4/2002

OTHER PUBLICATIONS

Romanovskiy V.P. Spravochnik po kholodnoy shtampovke. Leningrad, 1971, "Mashinostroenie", pp. 242-243; concise explanation of the relevance: Claim No. 1-3, 12-15 per International Search Report and Written Opinion for International Application No. PCT/US2015/054520, dated Jan. 28, 2016.

(Continued)

*Primary Examiner* — Teresa M Ekiert
(74) *Attorney, Agent, or Firm* — Dinsmore & Shohl LLP

(57) ABSTRACT

A process for forming a sheet metal component. The process includes rigidly clamping a piece of sheet metal to a clamping fixture and plastically deforming the sheet metal to produce a shaped component during a first manufacturing step. The shaped component has a first amount of springback. During a second manufacturing step, a pair of electrodes applies one or more pulses of electrical current at one or more locations on the shaped component while the shaped component is still rigidly clamped to the clamping fixture during. The one or more pulses of electrical current applied to the shaped component provide an electrically-assisted manufactured (EAM) shaped component. The EAM shaped component has a second amount of springback that is less than the first amount of springback.

23 Claims, 9 Drawing Sheets

(58) Field of Classification Search
USPC ..... 72/430
See application file for complete search history.

(56) References Cited

U.S. PATENT DOCUMENTS 8,021,501 B2 * 9/2011 Roth ..... B21D 31/005
72/342.96
8,534,109 B1 * 9/2013 Golovashchenko ... B21D 37/16
72/342.94

OTHER PUBLICATIONS

International Search Report and Written Opinion for International Application No. PCT/US2015/054520, dated Jan. 28, 2016.
Romanovskiy V.P. Spravochnik po kholodnoy shtampovke. Leningrad, 1971, "Mashinostroenie", pp. 242-243 with English translation.

* cited by examiner

METHOD FOR REDUCING SPRINGBACK USING ELECTRICALLY-ASSISTED MANUFACTURING

CROSS-REFERENCE TO RELATED APPLICATIONS

This National Phase application claims priority to International Patent Application No. PCT/US2015/054520 filed on Oct. 7, 2015, which claims priority to U.S. Provisional Patent Application No. 62/060,607 filed Oct. 7, 2014, both of which are incorporated herein by reference in their entirety.

GOVERNMENT SUPPORT

This invention was made with government support under Grant No. DE-EE0005764, awarded by the Department of Energy. The Government has certain rights in the invention.

FIELD OF THE INVENTION

The instant disclosure is related to an apparatus and/or process for reducing springback in sheet metal forming and in particular to using electrically-assisted manufacturing for reducing springback in single point incremental forming of sheet metal components.

BACKGROUND OF THE INVENTION

The use of single point incremental forming (SPIF) for forming sheet metal into a desired shape is known. Such forming typically places on a piece of sheet metal in a clamping fixture where it is held while SPIF processing is executed thereon. In addition, it is known that springback of the sheet metal can be present after SPIF manufacturing, and thus a less than desired shape can be present after the formed piece is removed from the clamping fixture. Therefore, an improved apparatus and process that reduces springback of a piece of sheet metal that has been formed by SPIF would be desirable.

SUMMARY OF THE INVENTION

A process for forming a piece of sheet metal is provided. The process includes providing the piece of sheet metal and a clamping fixture. The piece of sheet metal is rigidly clamped to the clamping fixture. Then, the piece of sheet metal is plastically deformed while it is rigidly clamped to the clamping fixture and a shaped component is formed during a first manufacturing step. Also, the shaped component has a first amount of springback.

During a second manufacturing step, a pair of electrodes configured to pass electrical current from one electrode to another electrode is used to apply one or more pulses of electrical current at one or more locations on the shaped component while the shaped component is still rigidly clamped to the clamping fixture. The one or more pulses of electrical current applied to the shaped component provide an electrically-assisted manufactured (EAM) shaped component that has a second amount of springback that is less than the first amount of springback.

The first manufacturing step can be an incremental forming process such as a single point incremental forming (SPIF) deformation process that uses an arcuate tipped tool to incrementally deform the piece of sheet metal and form the shaped component. The clamping fixture with the piece of sheet metal can be rigidly secured to an SPIF machine at a first workstation where the first manufacturing step forms the shaped component. Then the clamping fixture with the shaped component can be unsecured from the SPIF machine and moved to a second workstation where the second manufacturing step using the pair of electrodes is applied to the shaped component to form the EAM shaped component. In the alternative, the clamping fixture with the shaped component can remain rigidly secured to the SPIF at the first workstation while the pair of electrodes apply the one or more pulses of electrical current at one or more locations on the shaped component during the second manufacturing step to form the EAM shaped component.

The one or more locations on the shaped component where the one or more electrical pulses are applied can be locations that are proximate and/or adjacent to areas of maximum residual stress in the shaped component, such areas being locations or regions of plastic deformation of the shaped component. The shaped component has a thickness and the pair of electrodes can be oppositely disposed across the thickness of the shaped component and the one or more pulses of electrical current pass through the thickness of the shaped component from one electrode to another electrode.

The second amount of springback is less than 25% of the first amount of springback, preferably less than 40%, and more preferably less than 50%.

As such, a process for forming a sheet metal component is disclosed. The process includes providing a piece of sheet metal having a thickness; providing a clamping fixture and rigidly clamping the piece of sheet metal to the clamping fixture; providing a single point incremental forming (SPIF) machine and rigidly securing the clamping fixture with the piece of sheet metal to the SPIF machine; plastically deforming the piece of sheet metal while the clamping fixture is rigidly secured to the SPIF machine and forming a shaped component from the piece of sheet metal during a first manufacturing step, the shaped component having a first amount of springback; providing a pair of electrodes configured to pass electrical current from one electrode to another electrode; and applying one or more pulses of electrical current at one or more locations on the shaped component while the shaped component is still rigidly clamped to the clamping fixture using the pair of electrodes during a second manufacturing step, the one or more pulses of electrical current applied to the shaped component providing an electrically-assisted manufactured (EAM) shaped component, the EAM shaped component having a second amount of springback that is less than the first amount of springback.

The process can also include the pair of electrodes being oppositely disposed the thickness of the piece of sheet metal during applying the one or more pulses of electrical current at one or more locations on the shaped component. The second amount of springback is less than 25% of the first amount of springback, preferably less than 40%, and more preferably less than 50%. The process can include the first manufacturing step being executed at a first workstation and the second manufacturing step being executed at a second workstation. In the alternative, the process can include the first manufacturing step and the second manufacturing steps being executed at a first workstation.

BRIEF DESCRIPTION OF THE DRAWINGS

FIG. 5 is a schematic illustration of a top view of the piece of sheet metal shown in FIG. 3 with spot or point locations identified for electrical current pulses to be applied to;

DESCRIPTION OF THE INVENTION

An apparatus and a process for reducing springback of a piece of sheet metal that has been subjected to incremental forming are provided. In some instances, the incremental forming is single point incremental forming (SPIF), however this is not required. For the purposes of the instant disclosure, the term "springback" is defined as the amount a work piece, e.g. a piece of sheet metal, that has been plastically deformed while rigidly clamped in a clamping fixture, reverts back to its original form or shape before being plastically deformed, after the work piece is removed from the clamping fixture.

It is appreciated that incremental forming typically uses a rounded or arcuate tipped tool to form simple and complex shapes. Limits in incremental forming are usually caused by the material being formed, the wall angle of the part to be formed and the springback of the formed piece. The springback is due to or caused by residual stresses which occur during the forming process. Also, the residual stresses discussed herein do not cause visible springback until the work piece, i.e. the piece of sheet metal, is unclamped from its clamping fixture.

The process disclosed herein takes a piece of sheet metal, clamps it to a rigid clamping fixture and then rigidly secures the rigid clamping fixture with the piece of sheet metal to an incremental forming machine at a first work station. The piece of sheet metal is subjected to incremental forming while clamped to the clamping fixture in order to produce a shaped component. Also, the clamping fixture requires an outer periphery of the piece of sheet metal to remain stationary or fixed relative to the clamping fixture during plastic deformation of the piece of sheet metal. Residual stress is created in the piece of sheet metal during the plastic deformation and if the piece of sheet metal is removed from the clamping fixture, a first amount of springback is present.

Figure 1:
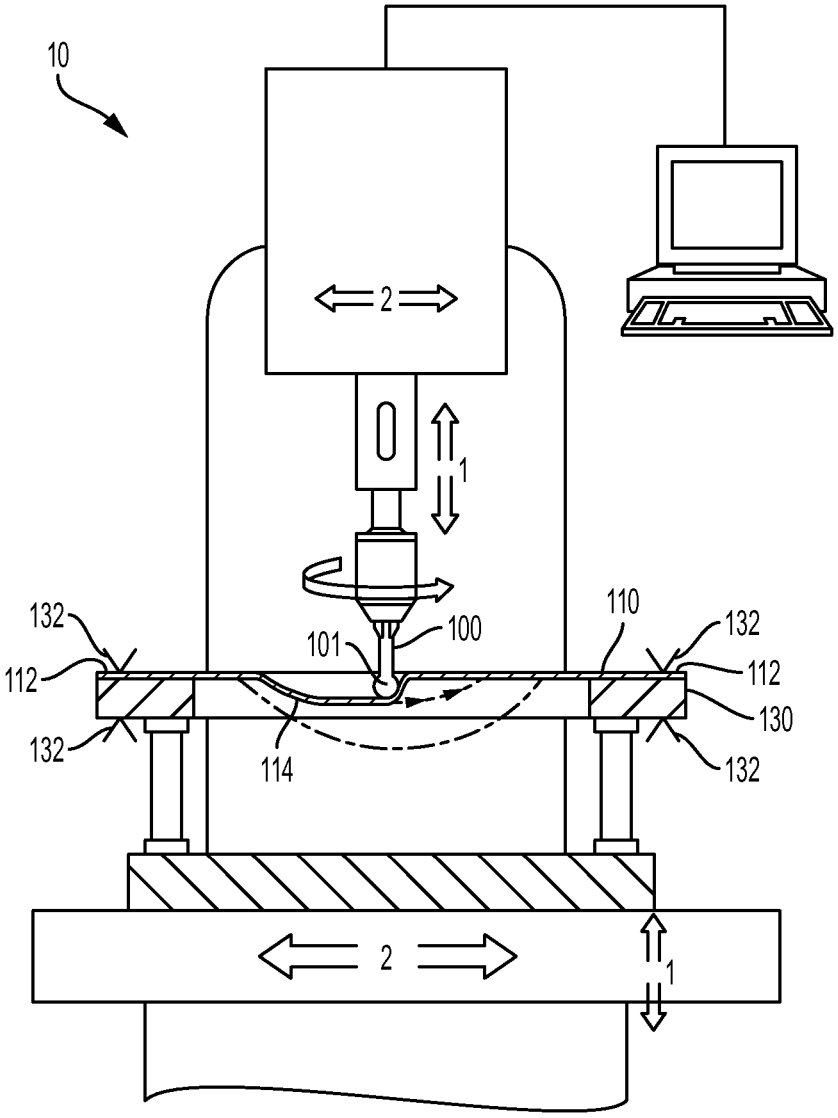
FIG. 1 is a schematic illustration of a single point incremental forming (SPIF) machine according to an aspect disclosed herein.

In some instances, and before the shaped component is removed from the clamping fixture, i.e. while the plastically deformed piece of sheet metal is still rigidly clamped to the clamping fixture, a pair of electrodes apply one or more pulses of electrical current at one or more locations on the shaped component and thereby produce an electrically-assisted manufactured (EAM) shaped component. The EAM shaped component is then removed from the clamping fixture and exhibits a reduced amount of springback, i.e. when the EAM shaped component is removed from the clamping fixture, a second amount of springback that is less than the first amount of springback is present. In this manner electrically-assisted manufacturing provides an EAM shaped component with less springback and thus a more desired shape compared to a similarly shaped component that is not subjected to electrically-assisted manufacturing. Stated differently, the problem of springback in incrementally formed components is reduced and/or eliminated using apparatus and/or process described herein Turning now to FIG. 1, a single point incremental forming (SPIF) machine 10 having an arcuate tipped tool 100 is shown. For the purposes of the instant disclosure the term "arcuate tipped tool" includes any tool with a curved shaped tip, illustratively including tools with a round shaped tip, spherical shaped tip and the like. The forming machine has a support structure 130 onto which a piece of sheet metal 110 can be placed. In some instances, the support structure 130 has a clamping fixture 132 that can rigidly hold an outer perimeter 112 of the piece of sheet metal 110 and leave a portion 114 of the sheet metal 110 unsupported. In addition, the arcuate tipped tool 100 may or may not have a spherical shaped head 101 with a shaft 123 extending therefrom.

The forming machine 120 can be a computer numerical controlled machine that can move the arcuate tipped tool 100 a predetermined distance in a predetermined direction. For example, the forming machine 10 can move the arcuate tipped tool 100 in a generally vertical (e.g. up and down) direction 1 and/or a generally lateral (e.g. side to side) direction 2. In the alternative, the support structure 130 can move the clamping fixture 132 with the piece of sheet metal 110 rigidly clamped thereto in the generally vertical direction 1 and/or the generally lateral direction 2 relative to the arcuate tipped tool 100. The arcuate tipped tool 100 can be rotationally fixed, free to rotate and/or be forced to rotate. After the clamping fixture 132 with the piece of sheet metal 110 has been attached to the support structure 130, the arcuate tipped tool 100 comes into contact with and makes a plurality of single point incremental deformations on the piece of sheet metal 110 and affords for a desirable shape to be made therewith.

Figure 2:
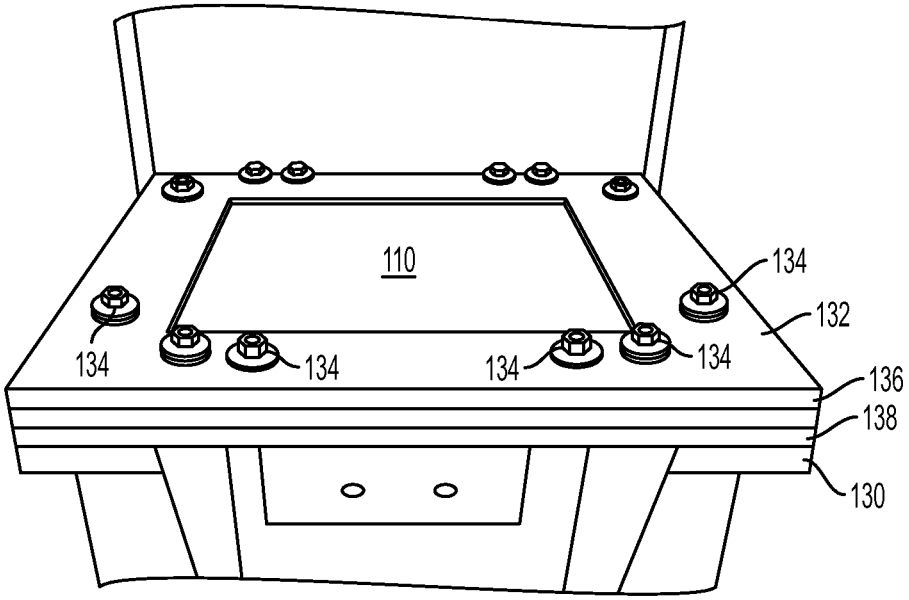
FIG. 2 is a schematic illustration of a clamping fixture rigidly holding a piece of sheet prior to SPIF.

FIG. 2 provides a schematic illustration of the clamping fixture 132 with the piece of sheet metal 110 rigidly clamped thereto. It is appreciated that the clamping fixture 132 prevents the outer perimeter or outer periphery 112 of the piece of sheet metal 110 from moving relative to the clamping fixture 132 during the SPIF process. As illustrated in FIG. 2, one or more threaded fasteners 134 can be used to clamp a top portion 136 to a bottom portion 138 of the clamping fixture 132 and thereby rigidly clamp or sandwich the piece of sheet metal 110 therebetween. It is also appreciated that the clamping fixture 132 can prevent only a portion of the outer periphery 112 of the piece of sheet metal 110 to move relative to the clamping fixture 132 during the SPIF process, i.e. one or two sides or edges of the piece of sheet metal 110 can be allowed to move during the SPIF process so long as two or more sides or edges of the piece of sheet metal are held secure by the clamping fixture 132.

Figure 3:
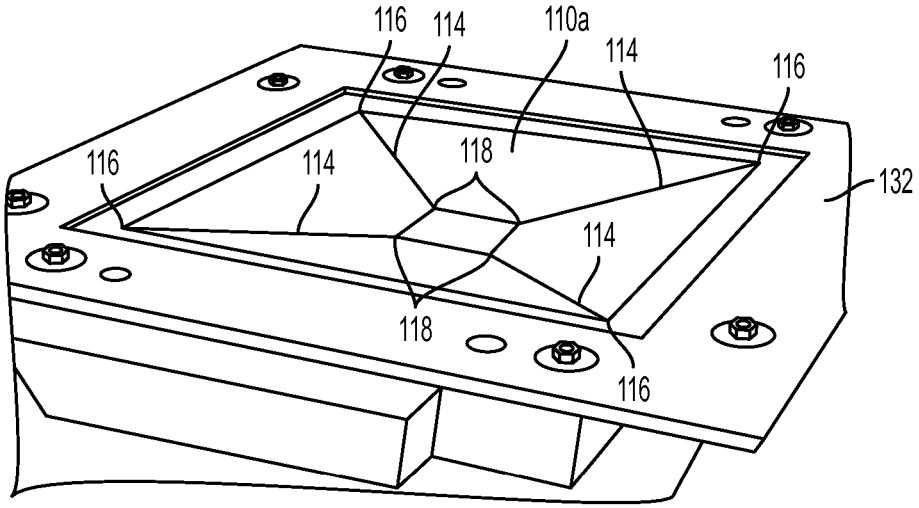
FIG. 3 is a schematic illustration of the clamping fixture and piece of sheet metal shown in FIG. 2 after SPIF.

FIG. 3 provides a schematic illustration of the piece of sheet metal 110 after being plastically deformed via SPIF into a shaped component 110*a* and yet still rigidly clamped to the clamping fixture 132. As shown in the figure, the SPIF process has produced four linear deformation seams 114 with corresponding corners 116, 118 that have provided a pyramidal shape out of the piece of sheet metal 110.

Figure 4:
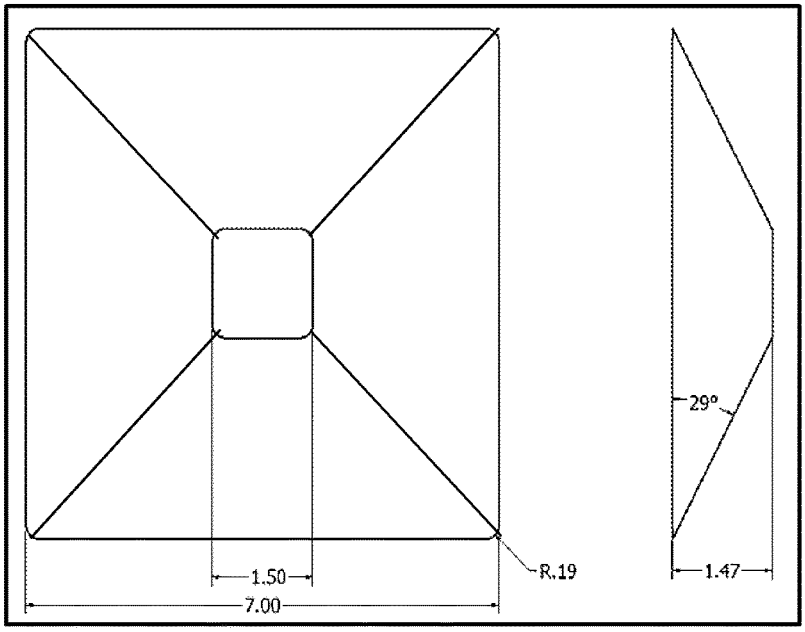
FIG. 4 is a schematic illustration of a top view and a side view of the piece of sheet metal shown in FIG. 3.
Figure 5:
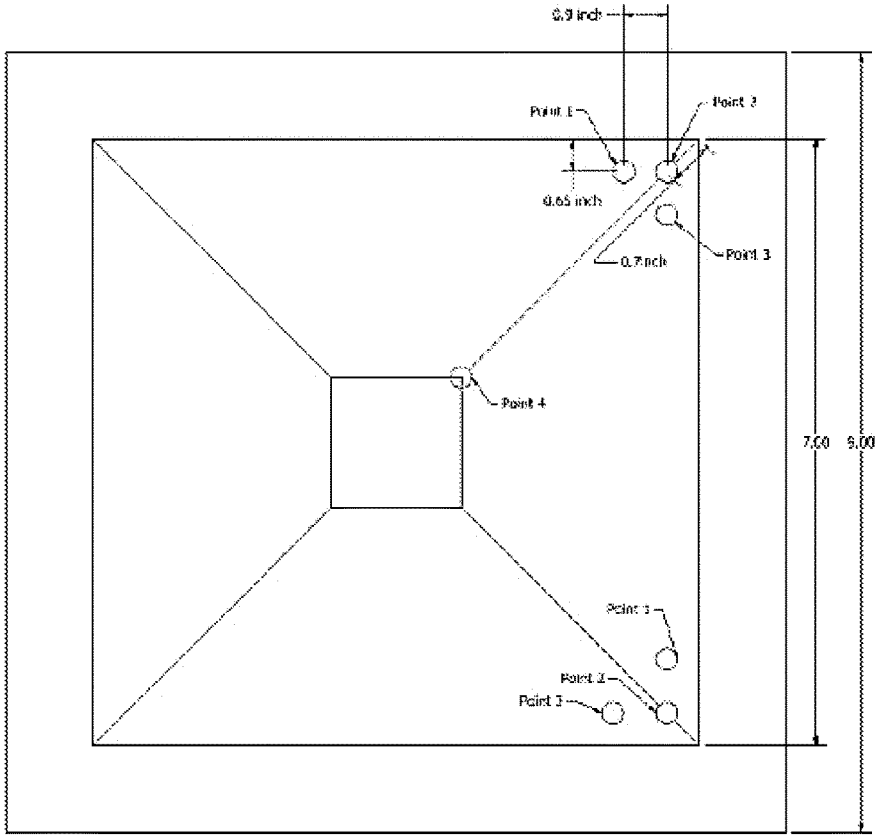

FIG. 4 provides a schematic illustration of a top view and side of the shaped component 110*a* shown in FIG. 3 and FIG. 5 illustrates the shaped component 110*a* with various points selected for one or more electrical pulses to be applied thereto (through-thickness electrical pulses) or for electrical current pulses to be applied between the various points (point-to-point electrical pulses).

Figure 6:
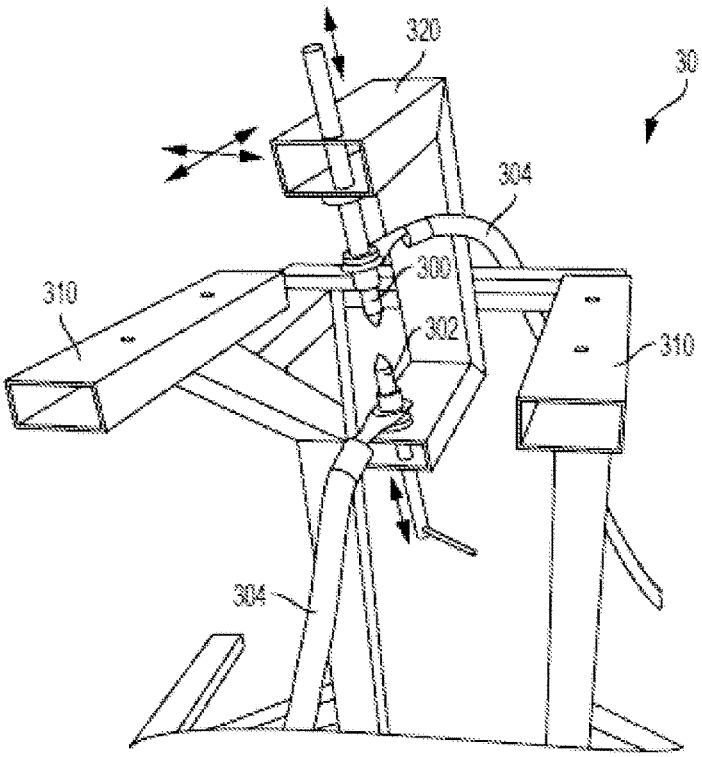
FIG. 6 is a schematic illustration of a work station where electrical current is passed through the piece of sheet metal illustrated in FIG. 3 at one or more locations.

FIG. 6 illustrates an electrode assembly 30 having a pair of electrodes 300, 302 and a frame support structure 310. An electrode tower 320 supports the pair of electrodes 300, 302 and can have two-dimensional (3D) or three-dimensional (3D) movement as illustrated by the double-headed arrows in the figure. It is appreciated that the pair of electrodes 300, 302 are electrically connected to an electrical power supply (not shown) via electrical cables 304 such that electrical current can pass from one of the electrodes to the other electrode.

Figure 7:
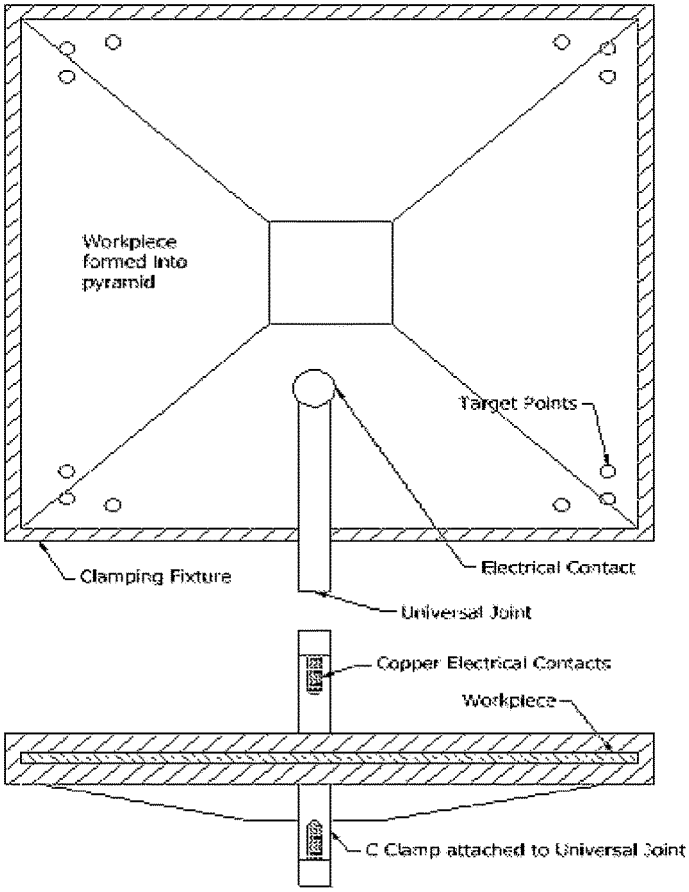
FIG. 7 is a schematic illustration of a top view of the piece of sheet metal shown in FIG. 3 with electrodes in place to apply electrical current pulses to various points or locations of high residual stress and/or high deformation.
Figure 8:
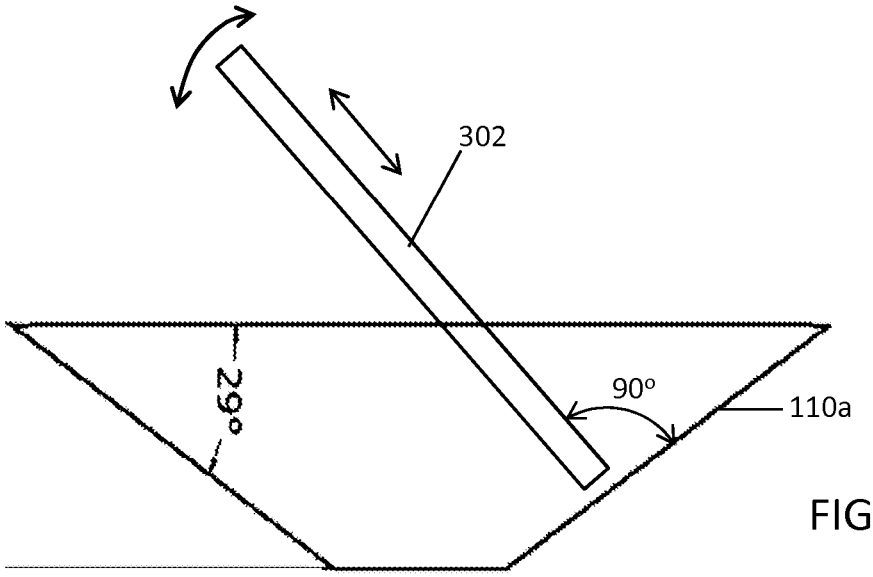
FIG. 8 is a schematic illustration of a side view of the piece of sheet metal shown in FIG. 3 illustrating that electrodes can have a range of motion and degrees of freedom to allow for a normal orientation of the electrodes relative to a surface where one or more electrical pulses are to be applied.

The clamping fixture 132 with the shaped component 110*a* still rigidly clamped therein illustrated in FIG. 3, can be removed from the SPIF machine 10 and placed on and/or clamped to the electrode assembly 30. Then, the pair of electrodes 300, 302 can be used to apply one or more pulses of electrical current at one or more locations on the shaped component 110*a* that is rigidly clamped to the clamping fixture 132. For example, the electrodes 300, 302 can apply one or more through-thickness electrical pulses on and/or proximate to the target points shown in FIG. 7 and/or apply one or more point-to-point electrical pulses between the target points. It is appreciated that the electrodes 300 and/or 302 can have multiple degrees of freedom in order to afford the electrodes to be oriented normal to a surface where one or more electrical pulses are to be applied as illustrated in FIG. 8. In this manner an electrically-assisted manufactured (EAM) shaped component is produced. Thereafter, the EAM shaped component can be removed from the clamping fixture 132. In addition, and as illustrated in the examples provided below, the EAM shaped component has a springback that is less than the springback for the shaped component 110*a* if it were removed from the clamping fixture 132 before the application of the one or more pulses of electrical current at the one or more locations on the shaped component 110 via the electrode assembly 30.

The springback exhibited by the EAM shaped component can be less than 25% of the shaped component, preferably less than 40 springback, and more preferably less than 50% springback.

Figure 9:
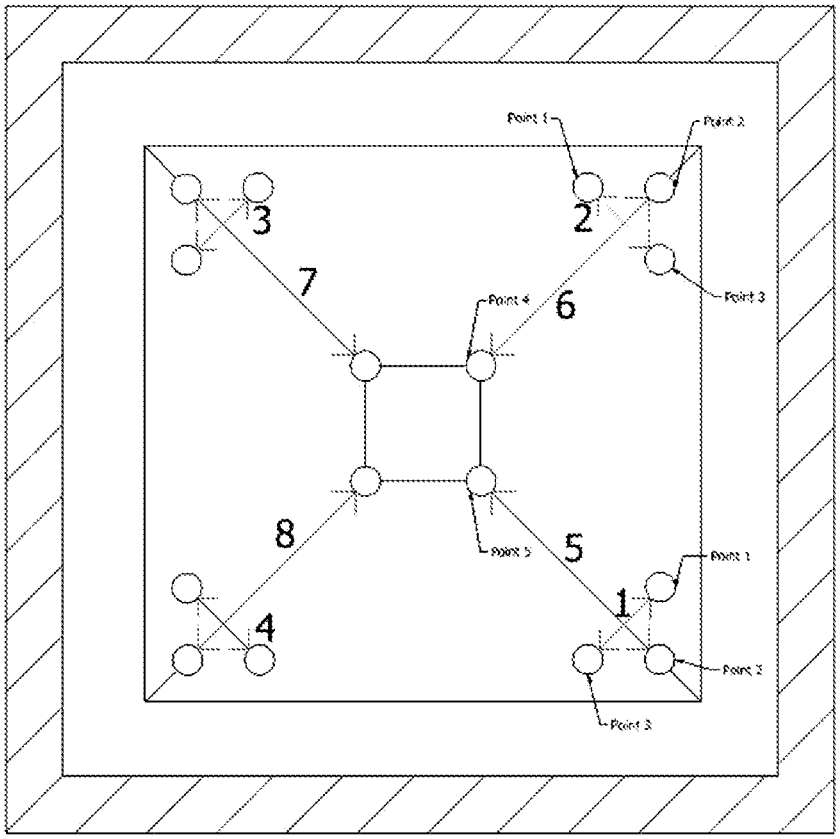
FIG. 9 is a schematic illustration of a top view of the piece of sheet metal shown in FIG. 3 illustrating various point-to-point scenarios where one or more electrical pulses can be applied.

Turning now to FIG. 9, a range of point-to-point electrical pulse scenarios is shown. For example, scenario 1 applies one or more point-to-point electrical pulses between point 1 and point 3 in a given corner, scenario 2 applies one or more point-to-point electrical pulses between point 1 and point 3 in a different corner, scenario 5 applies one or more point-to-point electrical pulses between point 2 and point 5 along a deformation seam, scenario 6 applies one or more point-to-point electrical pulses between point 2 and point 4 along a different deformation seam, etc.

Figure 10:
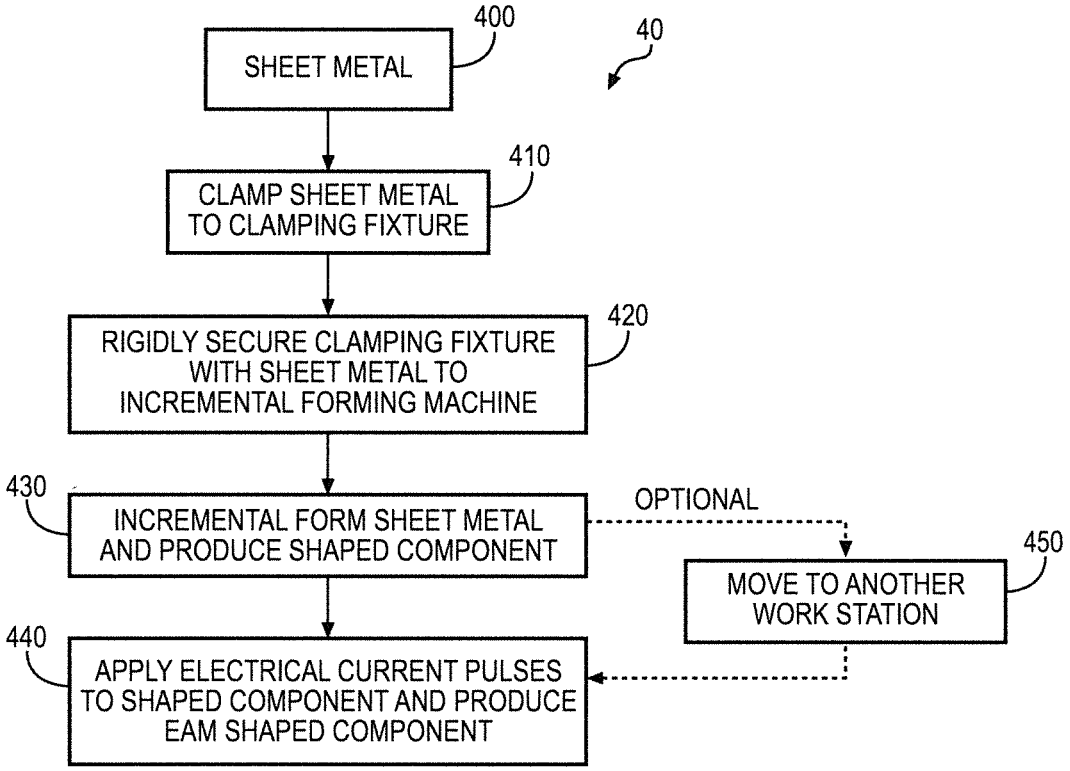
FIG. 10 is schematic illustration of a process for producing an electrically-assisted manufactured (EAM) shaped component.

Turning now to FIG. 10, a schematic illustration of a process for producing an EAM shaped component is shown generally at reference number 40. The process 40 includes providing a piece of sheet metal to be incrementally formed at step 400. At step 410, the piece of sheet metal is rigidly clamped to a clamping fixture that is configured to rigidly clamp at least a portion of the piece of sheet metal during an incremental forming manufacturing step. The piece of sheet metal is rigidly secured to an incremental forming machine via the clamping fixture at step 420 and incremental forming, e.g. SPIF, is performed on the piece of sheet metal and a shaped component is produced at step 430 during a first manufacturing step.

At step 440, the shaped component, while still being rigidly clamped to the clamping fixture, is then subjected to one or more electrical pulses at one or more locations during a second manufacturing step and an EAM shaped component is produced. The application of the one or more electrical pulses at the one or more locations on the shaped component can be executed while the clamping fixture with the shaped component rigidly clamped thereto is still rigidly secured to the incremental forming machine. In the alternative, at step 450, the clamping fixture with the shaped component rigidly clamped thereto can be removed from the incremental forming machine and placed at a different workstation where, at step 440, the one or more electrical pulses at the one or more locations on the shaped component is applied to the shaped component.

In order to better explain the teachings of the instant disclosure but not limit its scope in any manner, one or more examples with experimental data and results is provided below. Experimental Setup Samples for testing were cut from a 2024-T3 aluminum sheet that was 0.5 millimeters (mm) thick using a sheet metal shear. The samples were square shaped and had dimensions of 280 mm×280 mm. During incremental forming a sample was clamped into a clamping fixture and then incrementally formed using a HAAS VF3 mill. The desired shaped component was a pyramid with a 178 mm square base, a 38 mm square top and walls with a 29° angle relative to a vertical axis. The pyramid was formed using an out-to-in forming technique with a step down size of 0.25 mm and a step over size of 0.46 mm.

After forming, the clamping fixture with the shaped component still rigidly clamped thereto was removed from the mill and set onto an electrode assembly. An electrical power supply in the form of a Lincoln R35 Arc Welder with a thermally controlled variable resistor was connected to the electrode assembly to supply electric current to a pair of oppositely disposed electrodes. One of the electrodes was on one side of the piece of sheet metal and the other electrode on an opposite side, i.e. across the thickness of the piece of sheet metal.

Tests were run with 4 different current densities (40, 50, 60, 70 A/mm$^2$), 4 different time intervals (1, 2, 3, 4 seconds), and a varying number of applied current locations based on a finite element analysis (FEA) which showed high stress concentrations in the corners of the formed pyramid close to the edge of the shaped component. The clamping fixture with the shaped component, also referred to as the work piece, was clamped into the electrode assembly and then one or more pulses of electrical current was applied through a location with a high stress concentration. The part was then rotated and current was pulsed through another location. This process was repeated until the desired number of stress concentrations had been pulsed with current. The pulsed current was applied to the shaped component in a clockwise direction, i.e. current pulses were applied at one corner of the shaped component and then the clamping fixture with the shaped component was turned or rotated clockwise to the next corner where the pair of electrodes applied pulses of electrical current.

After testing, the specimens were painted white on 1 side and scanned with a Zscanner 700 hand held 3D scanner. The scanned data was imported as CAD files for comparison with a desired shape CAD model.

FEA Model and Theory

A FEA simulation model of the experiment was developed with the ANSYS® software. The final formed part exhibited two plane of reflective symmetry, so a three-dimensional, quarter-symmetry model was developed for this study. The model used a lower-order, four-node quadrilateral-shaped, structural shell finite element formulation to represent the sheet metal part. While the forming process itself had no symmetry, using the symmetry approximation yields significant savings in simulation time and resulting file storage demand. The piece of sheet metal was assumed to be of uniform thickness and the material was isotropic and homogeneous. The forming tool was modeled as a series of rigid spheres which contact the piece of sheet metal to create the intended shaped component. A series of forming tools was used since it saved simulation time by starting a new tool for each pass over the plate rather than moving the original tool to a new starting position after the previous forming pass was completed. In the ANSYS software the spherical tool was modeled using a rigid "target" element and the corresponding surface of the metal plate was skinned with matching "contact" elements to detect the interference between the tool and the plate and to transmit forming forces to produce the final part shape.

The aluminum material properties were defined at room temperature as:

- Elastic modulus, E=73,000 megapascals (MPa) (or 10,588 ksi)
- Poisson's ratio, nu=0.33
- The coefficient of friction between the spherical tools and the aluminum plate is assumed to be 0.1, representing lubricated steel-on-aluminum friction behavior.

Results

The effects of current density, duration of the current pulse and the number of areas that electric current was pulsed were examined. To determine the springback of the formed pyramid shape the 3D scan data was imported into Geomagic Control along with a CAD model of the desired shape.

Geomagic control created 3D deviation plots and gave average differences between the test shape (scanned data) and the reference shape (CAD model). The 3D deviation in Geomagic control was the distance between a point on the reference model and the closest corresponding point on the test model. The deviation plot was always plotted on the reference model.

Current Density and Pulsed Locations

Figure 11:
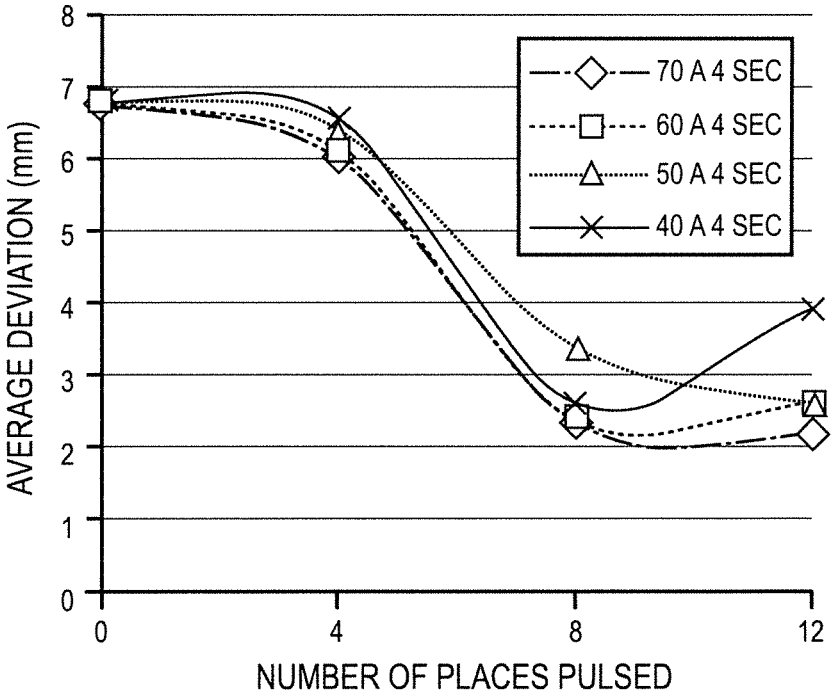
FIG. 11 is a graphical illustration of average deviation versus number of electrically pulsed locations for various currents and a pulse time of 4 seconds.

In one test, four (4) different current densities, all with a time period of 4 seconds, at a varying number of spots or locations were applied to test samples. The current densities tested were 40, 50, 60 and 70 A/mm$^2$ and at 4, 8 and 12 stress concentration locations. FIG. 11 illustrates a plot of average deviation acquired by Geomagic vs current density. The current density data for zero (0) number of pulses was the deviation value for the control specimen (no electric current used). Overall the 70 A/mm$^2$ had the most springback elimination at each number of locations pulsed, though the other values (40, 50, 60 A/mm$^2$) were within 1 mm deviation of the 70 A/mm$^2$ results.

The number of locations or places pulsed with electric current had a larger impact on the springback of the pyramid shape than the range of current density. When only 4 spots were pulsed, one in each corner of the pyramid, the average deviation difference was approximately 1 mm when compared to the control specimen. However, when the number of locations was increased to 8 the average deviation dropped from 6.25 mm to 2.64 mm. Also, increasing the number of locations to 12 did not appear to increase the average deviation. The data also showed that pulsing electrical current at multiple locations adjacent to a deformed corner, i.e. to the side of the corner had a greater effect in reducing springback than applying electrical current directly in or on the corner of the formed specimen.

Figure 12:
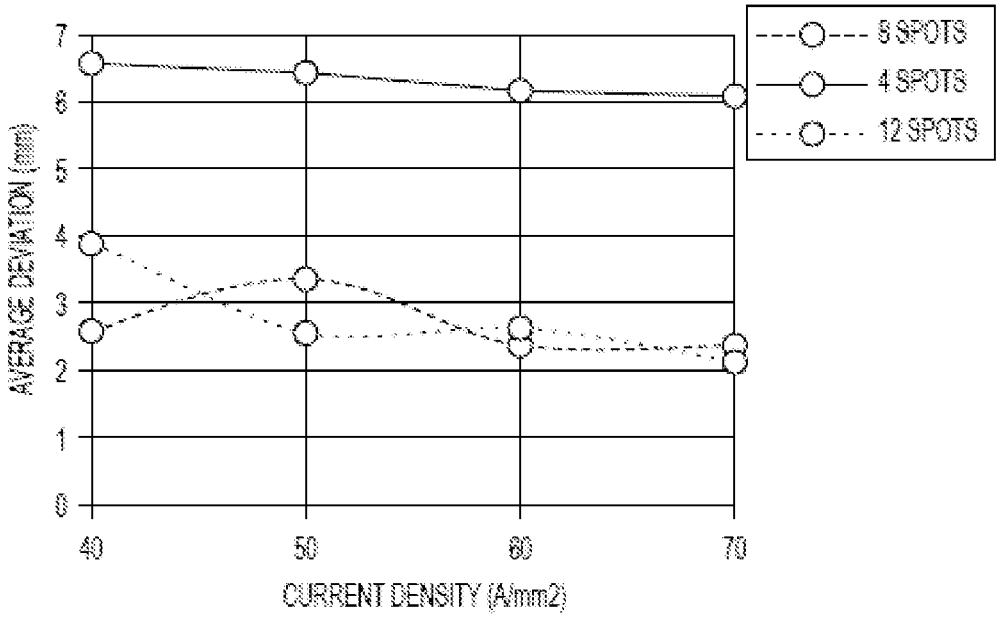
FIG. 12 is a graphical illustration of average deviation versus current density for various electrically pulsed locations.

FIG. 12 illustrates the data in FIG. 11 when plotted as average deviation versus current density, and with each data set corresponding to the number of spots pulsed. As shown in the figure, it was clear that the 4 spot test had more springback than the 8 spot and 12 spot tests. The data also illustrates the greater impact on number of spots or locations being pulsed when compared to the variation in electrical current density.

FIG. 12 illustrates average deviation as function of current density. As shown in the figure, the number of spots where one or more electrical pulses (compare 4 spots versus 8 and 12 spots) are applied has a greater effect than current density.

Figure 13:
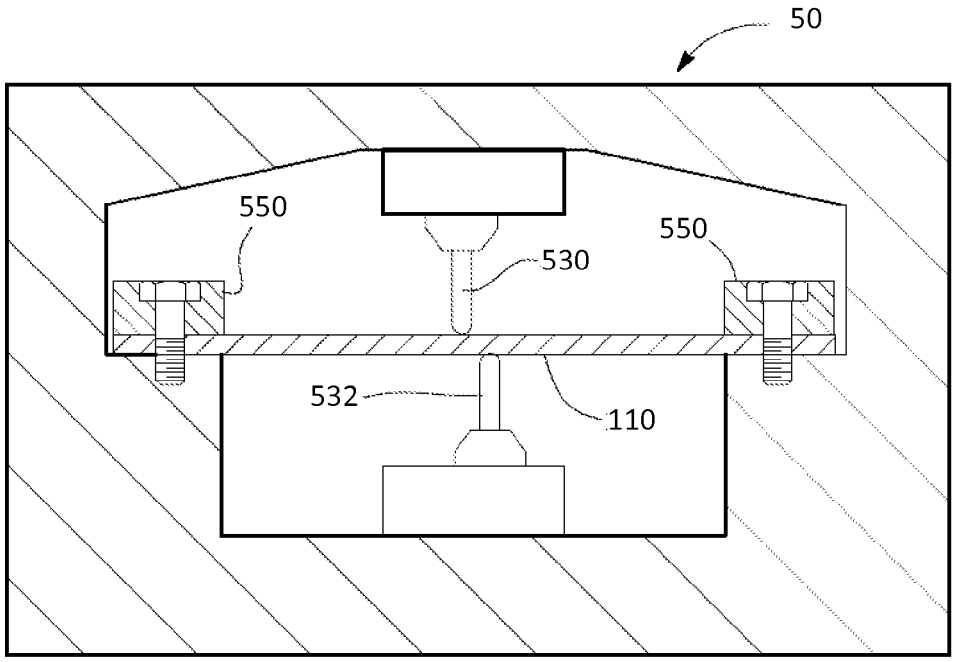
FIG. 13 is a schematic illustration of a double point incremental forming (DPIF) machine according to an aspect disclosed herein.

FIG. 13 illustrates a double point incremental forming machine 50 with a clamping fixture 550, a pair of arcuate tipped tools 530, 532 and a piece of sheet metal 110. In addition, it is appreciated an EAM shaped component can be formed by applying one or more electrical pulses to a shaped component formed by any type of incrementally forming known to those skilled in the art and incremental forming techniques not yet known or developed but which residual stresses and/or plastic deformation in a piece of sheet metal.

Figure 14:
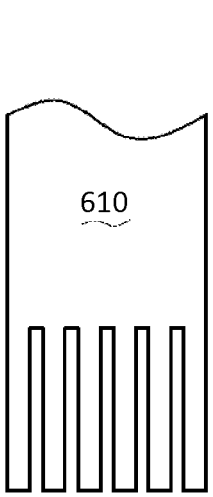
FIG. 14 is a schematic illustration of an electrode head according to an aspect disclosed herein.
Figure 15:
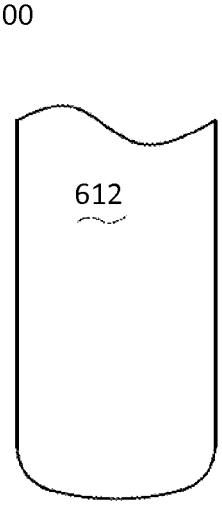
FIG. 15 is a schematic illustration of an electrode head according to another aspect disclosed herein.
Figure 16:
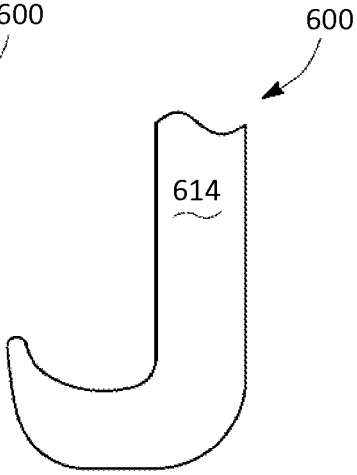
FIG. 16 is a schematic illustration of an electrode head according to yet another aspect disclosed herein.
Figure 17:
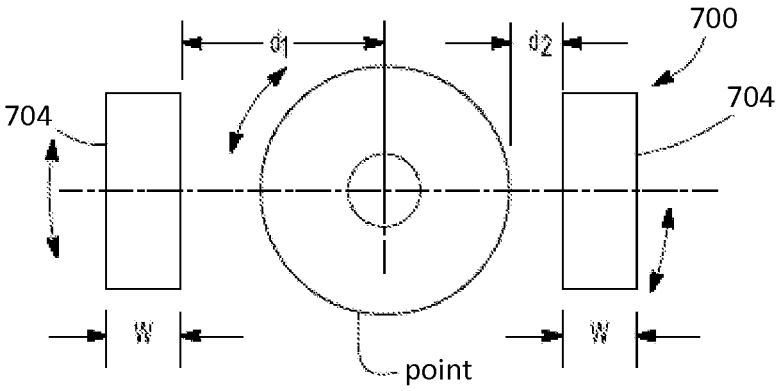
FIG. 17 is a schematic illustration of an electrode head according to of still another aspect disclosed herein.
Figure 18:
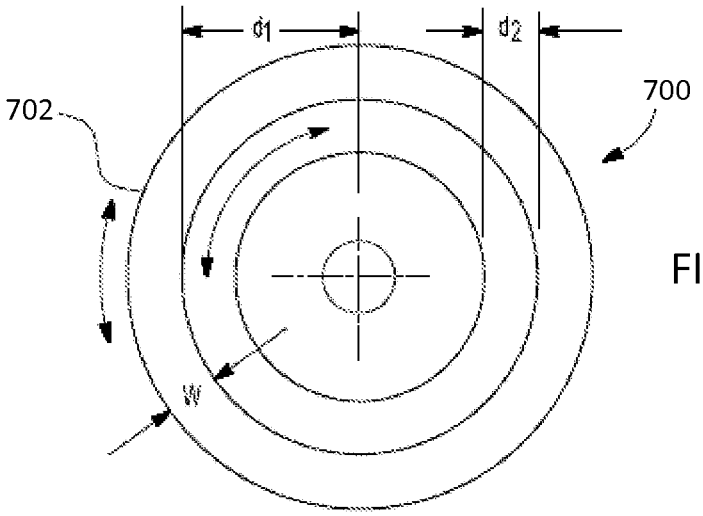
FIG. 18 is a schematic illustration of an electrode head according to yet still another aspect disclosed herein.
Figure 19:
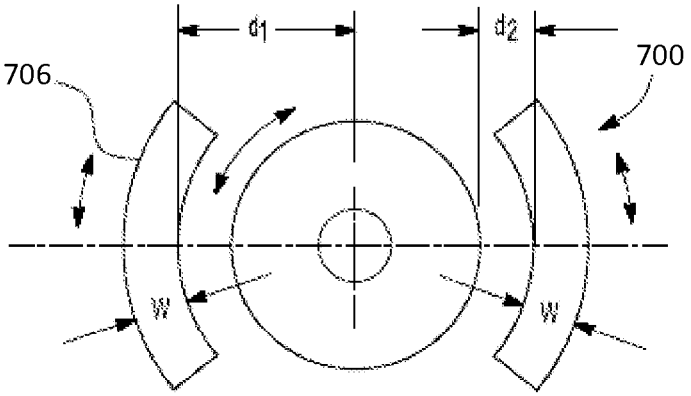
FIG. 19 is a schematic illustration of an electrode head according to still yet another aspect disclosed herein.

FIGS. 14-16 illustrate different shaped heads for electrodes 600, illustratively a brush type head 610, a curved shaped head 612 and a J-shaped head 614. Furthermore, FIGS. 17-19 illustrate a top view for a series of different shaped electrodes 700. For example, the electrode 700 in FIG. 17 is two rectangular shaped electrodes 704 having a width 'W' and being spaced apart from a center of a given point where one or more electrical pulses is to be applied by a distance $d_1$. In the alternative, the electrode 700 in FIG. 18 is a cylindrical shaped electrode 702 with a thickness "W" and spaced apart from a center of a given point where one or more electrical pulses is to be applied by a distance $d_1$. Finally, the electrode 700 in FIG. 19 is a pair of truncated cylindrical shaped electrodes 706 having a thickness "W" and spaced apart from a center of a given point where one or more electrical pulses is to be applied by a distance $d_1$. It is appreciated that tip of the electrodes can be any shaped tipped as discussed above and that the distance $d_1$ can range 1-2 millimeters (mm) to 25-100 mm. In addition, the electrodes can be used for applying through-thickness electrical pulses and/or point-to-point electrical pulses.

The disclosure provides various examples, aspects, etc., but the scope of the disclosure is not limited to such teaching. Changes, modifications, and the like will occur to those skilled in the art and yet still fall within the scope of the instant disclosure. Therefore, it is the claims, and all equivalents thereof, which define the scope.

I claim:

1. A process for forming a sheet metal component comprising:

providing a piece of sheet metal;

providing a clamping fixture at a first workstation and rigidly clamping the piece of sheet metal to the clamping fixture;

performing a first manufacturing step of plastically deforming the piece of sheet metal while it is rigidly clamped to the clamping fixture and forming a shaped component from the piece of sheet metal, the shaped component having a first amount of springback;

unsecuring the clamping fixture and moving the shaped component to a clamping fixture of a second workstation;

providing at the second workstation a pair of electrodes configured to pass electrical current from one electrode to another electrode;

performing a second manufacturing step of applying one or more pulses of electrical current at one or more locations on the shaped component while the shaped component is rigidly clamped to the clamping fixture of the second workstation using the pair of electrodes, the one or more pulses of electrical current applied to the shaped component providing an electrically-assisted manufactured (EAM) shaped component, the EAM shaped component having a second amount of springback that is less than the first amount of springback.

2. The process of claim 1, wherein performing the first manufacturing step is an incremental forming deformation process.

3. The process of claim 2, wherein performing the incremental forming deformation process is a single point incremental forming (SPIF) deformation process using an arcuate tipped tool to incrementally deform the piece of sheet metal and form the shaped component.

4. The process of claim 1, wherein forming the shaped component further comprises securing the clamping fixture with the piece of sheet metal rigidly to an SPIF machine at the first workstation before the first manufacturing step.

5. The process of claim 1, wherein performing the second manufacturing step further comprises applying the one or more pulses of electrical current at the one or more locations on the shaped component that are proximate to areas of maximum residual stress in the shaped component.

6. The process of claim 5, wherein performing the second manufacturing step further comprises applying one or more pulses of electrical current at the areas of maximum residual stress that have plastic deformation in the shaped component.

7. The process of claim 1, wherein performing the second manufacturing step further comprises applying one or more pulses of electrical current on the shaped component having a thickness and the pair of electrodes being oppositely disposed across the thickness of the shaped component and the one or more pulses of electrical current passing through the thickness of the shaped component from one electrode to another electrode.

8. The process of claim 1, wherein performing the second manufacturing step further comprises using the pair of electrodes for applying one or more point-to-point electrical pulses to the shaped component.

9. The process of claim 1, wherein performing the second manufacturing step further comprises reducing the second amount of springback to less than 25% of the first amount of springback, less than 40%, or less than 50%.

10. A process for forming a sheet metal component comprising:

providing a piece of sheet metal having a thickness;

providing a clamping fixture and rigidly clamping the piece of sheet metal to the clamping fixture;

providing a single point incremental forming (SPIF) machine and rigidly securing the clamping fixture with the piece of sheet metal to the SPIF machine;

performing a first manufacturing step of plastically deforming the piece of sheet metal while the clamping fixture is rigidly secured to the SPIF machine and forming a shaped component from the piece of sheet metal, the shaped component having a first amount of springback;

providing a pair of electrodes configured to pass electrical current from one electrode to another electrode;

performing a second manufacturing step of applying one or more pulses of electrical current at one or more locations on the shaped component while the shaped component is still rigidly clamped to the clamping fixture using the pair of electrodes, the one or more pulses of electrical current applied to the shaped component providing an electrically-assisted manufactured (EAM) shaped component, the EAM shaped component having a second amount of springback that is less than the first amount of springback;

wherein the pair of electrodes are oppositely disposed across the thickness of the piece of sheet metal during the steps of applying the one or more pulses of electrical current at one or more locations on the shaped component.

11. The process of claim 10, wherein performing the second manufacturing step further comprises reducing the second amount of springback to less than 25% of the first amount of springback, less than 40%, or less than 50%.

12. The process of claim 10, further comprises executing the first manufacturing step at a first workstation and executing the second manufacturing step at a second workstation.

13. A process for forming a sheet metal component comprising:

providing a piece of sheet metal;

providing a clamping fixture and rigidly clamping the piece of sheet metal to the clamping fixture;

performing a first manufacturing step of plastically deforming the piece of sheet metal while it is rigidly clamped to the clamping fixture and forming a shaped component from the piece of sheet metal, the shaped component having a first amount of springback and a thickness;

providing a pair of electrodes oppositely disposed across the thickness of the shaped component and configured to pass electrical current from one electrode to another electrode;

performing a second manufacturing step of applying one or more pulses of electrical current at one or more locations on the shaped component while the shaped component is still rigidly clamped to the clamping fixture using the pair of electrodes during the second manufacturing step, the one or more pulses of electrical current passing through the thickness of the shaped component from one electrode to another electrode and providing an electrically-assisted manufactured (EAM) shaped component, the EAM shaped component having a second amount of springback that is less than the first amount of springback.

14. The process of claim 13, wherein the first manufacturing step is an incremental forming deformation process.

15. The process of claim 14, wherein the incremental forming deformation process is a single point incremental forming (SPIF) deformation process using an arcuate tipped tool to incrementally deform the piece of sheet metal and form the shaped component.

16. The process of claim 13, wherein forming the shaped component further comprises securing the clamping fixture with the piece of sheet metal rigidly to an SPIF machine at a first workstation before the first manufacturing step.

17. The process of claim 16, wherein performing the second manufacturing step further comprises applying the one or more pulses of electrical current at one or more locations on the shaped component using the pair of electrodes while the clamping fixture with the shaped component remains rigidly secured to the SPIF at the first workstation.

18. The process of claim 13, wherein performing the second manufacturing step further comprises applying the one or more pulses of electrical current at the one or more locations that are proximate to areas of maximum residual stress in the shaped component.

19. The process of claim 18, wherein the areas of maximum residual stress are areas of plastic deformation in the shaped component.

20. The process of claim 13, wherein the second manufacturing step further comprises applying one or more point-to-point electrical pulses to the shaped component using the pair of electrodes.

21. The process of claim 13, wherein performing the second manufacturing step further comprises reducing the second amount of springback to less than 25% of the first amount of springback, less than 40%, or less than 50%.

22. A process for forming a sheet metal component comprising:

providing a piece of sheet metal having a thickness;

providing a clamping fixture at a first workstation and rigidly clamping the piece of sheet metal to the clamping fixture;

providing a single point incremental forming (SPIF) machine and rigidly securing the clamping fixture with the piece of sheet metal to the SPIF machine;

performing a first manufacturing step of plastically deforming the piece of sheet metal at the first workstation while the clamping fixture is rigidly secured to the SPIF machine and forming a shaped component from the piece of sheet metal, the shaped component having a first amount of springback;

unsecuring the clamping fixture and moving the shaped component to a clamping fixture of a second workstation;

providing a pair of electrodes configured to pass electrical current from one electrode to another electrode at the second workstation;

performing a second manufacturing step of applying one or more pulses of electrical current at one or more locations on the shaped component at the second workstation while the shaped component is still rigidly clamped to the clamping fixture using the pair of electrodes, the one or more pulses of electrical current applied to the shaped component providing an electrically-assisted manufactured (EAM) shaped component, the EAM shaped component having a second amount of springback that is less than the first amount of springback.

23. The process of claim 22, wherein pertaining the second manufacturing step further comprises reducing the second amount of springback to less than 25% of the first amount of springback, less than 40%, or less than 50%.

* * * * *